US007175902B2

(12) United States Patent
Ortega et al.

(10) Patent No.: US 7,175,902 B2
(45) Date of Patent: Feb. 13, 2007

(54) NONWOVEN FABRICS CONTAINING YARNS WITH VARYING FILAMENT CHARACTERISTICS

(75) Inventors: Albert E. Ortega, Pensacola, FL (US); R. Wayne Thomley, Pensacola, FL (US); Jan Mackey, Gulf Breeze, FL (US); Charles F. Shafer, Stockton, AL (US)

(73) Assignee: Cerex Advanced Fabrics, Inc., Cantonment, FL (US)

( * ) Notice: Subject to any disclaimer, the term of this patent is extended or adjusted under 35 U.S.C. 154(b) by 18 days.

(21) Appl. No.: 10/273,543

(22) Filed: Oct. 18, 2002

(65) Prior Publication Data

US 2003/0096549 A1 May 22, 2003

Related U.S. Application Data

(60) Provisional application No. 60/348,191, filed on Oct. 18, 2001.

(51) Int. Cl.
*B32B 3/00* (2006.01)
*D04H 3/16* (2006.01)

(52) U.S. Cl. ..... 428/196; 428/107; 428/296.7; 442/401; 442/361; 442/338

(58) Field of Classification Search ..... 428/85, 428/95, 109, 107, 113, 296.7, 196, 34.1; 442/361, 401, 338
See application file for complete search history.

(56) References Cited

U.S. PATENT DOCUMENTS

| | | | | |
|---|---|---|---|---|
| 3,576,687 | A | 4/1971 | Parlin | |
| 3,605,666 | A | 9/1971 | Kimmel et al. | |
| 3,819,462 | A * | 6/1974 | Starr et al. | 428/93 |
| 3,853,659 | A | 12/1974 | Rhodes | |
| 3,932,682 | A * | 1/1976 | Loft et al. | 442/374 |
| 3,968,307 | A | 7/1976 | Matsui et al. | |
| 4,020,229 | A | 4/1977 | Cox | |
| 4,041,203 | A | 8/1977 | Brock et al. | |
| 4,052,146 | A | 10/1977 | Sternberg | |
| 4,107,364 | A | 8/1978 | Sisson | |
| 4,144,370 | A | 3/1979 | Boulton | |
| 4,406,850 | A | 9/1983 | Hills | |
| 4,424,257 | A | 1/1984 | Bach | |
| 4,424,258 | A | 1/1984 | Bach | |
| 4,595,438 | A | 6/1986 | Kent et al. | |
| 4,656,081 | A | 4/1987 | Ando et al. | |
| 4,830,904 | A | 5/1989 | Gessner et al. | |
| 4,906,513 | A | 3/1990 | Kebbell et al. | |
| 4,987,664 | A | 1/1991 | McCullough et al. | |
| 5,108,827 | A | 4/1992 | Gessner | |
| 5,190,821 | A * | 3/1993 | Goodall et al. | 428/398 |
| 5,200,260 | A | 4/1993 | Hsu | |
| 5,229,191 | A | 7/1993 | Austin | |
| 5,270,107 | A | 12/1993 | Gessner | |
| 5,368,913 | A * | 11/1994 | Ortega | 428/198 |
| 5,393,599 | A | 2/1995 | Quantrille et al. | |
| 5,396,689 | A | 3/1995 | Vulllaume | |
| 5,431,986 | A | 7/1995 | Ortega et al. | |
| 5,464,676 | A | 11/1995 | Hoyt et al. | |
| 5,484,645 | A | 1/1996 | Lickfield et al. | |
| 5,534,339 | A | 7/1996 | Stokes | |
| 5,552,206 | A | 9/1996 | Knoke et al. | |
| 5,616,408 | A | 4/1997 | Oleszczuk et al. | |
| 5,652,041 | A | 7/1997 | Buerger et al. | |
| 5,660,910 | A * | 8/1997 | Hoyt et al. | 428/95 |
| 5,662,978 | A | 9/1997 | Brown et al. | |
| 5,679,042 | A | 10/1997 | Varona | |
| 5,752,945 | A | 5/1998 | Mosley et al. | |
| 5,783,503 | A | 7/1998 | Gillespie et al. | |
| 5,895,710 | A | 4/1999 | Sasse et al. | |
| 5,913,993 | A | 6/1999 | Ortega et al. | |
| 6,053,719 | A | 4/2000 | Barbier et al. | |
| 6,074,590 | A | 6/2000 | Gownder | |
| 6,207,276 | B1 | 3/2001 | Spindler et al. | |
| 2003/0021947 | A1* | 1/2003 | Tsiarkezos et al. | 428/102 |
| 2004/0221436 | A1 | 11/2004 | Ortega et al. | |

FOREIGN PATENT DOCUMENTS

| | | | |
|---|---|---|---|
| DE | 19641236 | A1 | 4/1998 |
| EP | 0305116 | A2 | 3/1989 |
| EP | 0421649 | A1 | 4/1991 |
| EP | 0822284 | A2 | 2/1998 |
| GB | 1 081 347 | | 8/1967 |
| GB | 1 491 602 | | 11/1977 |
| GB | 2 063 947 | A | 6/1981 |
| WO | WO 98/30744 | A1 | 7/1998 |
| WO | WO 99/23285 | A1 | 5/1999 |

* cited by examiner

*Primary Examiner*—Terrel Morris
*Assistant Examiner*—Lynda M. Salvatore
(74) *Attorney, Agent, or Firm*—Saliwanchik, Lloyd & Saliwanchik

(57) ABSTRACT

The subject invention provides non-woven fabrics having yarns of varying characteristics. In a preferred embodiment the subject invention provides nonwoven fabrics that comprise yarns of different deniers or cross sections. The use of these yarns gives the nonwoven fabric a unique appearance and advantageous properties. The subject invention further pertains to the processes used to produce these fabrics.

11 Claims, No Drawings

NONWOVEN FABRICS CONTAINING YARNS WITH VARYING FILAMENT CHARACTERISTICS

CROSS-REFERENCE TO RELATED APPLICATION

This application claims the benefit of provisional patent application Ser. No. 60/348,191, filed Oct. 18, 2001, which is hereby incorporated by reference in its entirety.

FIELD OF THE INVENTION

This invention relates to new nonwoven fabrics made having filaments with different deniers or cross sections and methods to produce such fabrics. Combining the filaments with different cross sections or deniers give these new fabrics advantageous properties and a unique appearance.

BACKGROUND OF INVENTION

Nonwoven fabrics and numerous uses thereof are well known to those skilled in the textiles art. Such fabrics can be prepared by forming a web of continuous filament and/or staple fibers and bonding the fibers at points of fiber-to-fiber contact to provide a fabric of requisite strength. The term "bonded nonwoven fabric" is used herein to denote nonwoven fabrics wherein a major portion of the fiber-to-fiber bonding is adhesive bonding accomplished via incorporation of adhesives in the web to "glue" fibers together or autogenous bonding such as obtained by heating the web or by the use of liquid or gaseous bonding agents (usually in conjunction with heating) to render the fibers cohesive.

Spunbonded nonwoven fabrics formed of nylon, polyester, polypropylene, or other polymers are widely used commercially for a number of purposes. Such fabrics exhibit excellent strength and uniformity of properties, and accordingly are desirable for use as coating substrates, construction fabrics, filtration materials, components in automotive fabrics, mattress pads and furniture and bedding backing materials.

The fabrics are produced via the well known spunbonding process in which molten polymer is extruded into filaments, and the filaments are attenuated and drawn pneumatically and deposited onto a collection surface to form a web. The filaments are bonded together to produce a strong, coherent fabric. Filament bonding is typically accomplished either thermally or chemically, i.e., autogenously. Thermal bonding is accomplished by compression of the web of filaments between the nip of a pair of cooperating heating calender rolls thereby setting the thickness.

In autogenous bonding of nylon filaments, the web of filaments is transported to a chemical bonding station or "gas house" which exposes the filaments to an activating agent (i.e., HC1) and water vapor. Water vapor enhances the penetration of the HC1 into the filaments and causes them to become tacky and thus amendable to bonding. Upon leaving the bonding station, the web passes between rolls which compress and bond the web thereby setting the thickness. In autogenous bonding of nylon filaments, the web of filaments is transported to a chemical bonding station or "gas house" which exposes the filaments to an activating agent (i.e., HC1) and water vapor. Water vapor enhances the penetration of the HC1 into the filaments and causes them to become tacky and thus amenable to bonding. Upon leaving the bonding station, the web passes between rolls which compress and bond the web thereby setting the sickness.

Adequate bonding is necessary to minimize fabric fuzzing (i.e., the presence of unbonded filaments) and to impart good strength properties to the fabric. Autogenous bonding has been especially used in forming spunbonded nylon industrial fabrics.

Typically, much effort is expended in the production of nonwoven fabrics to maintain and improve the distribution of filaments or uniformity of the fabric. This gives nonwoven fabrics a smooth or "uniform" appearance. In some applications, it is desirable to enhance the properties or change the appearance of the nonwoven fabric. This can be accomplished in carded or needle punched nonwovens through mechanical means or by changing the mixture or recipe of the staple yarn feed stocks. However, it is difficult to accomplish this task on sunpbounded fabrics. A nonwoven fabric with a unique appearance or enhanced properties accomplished by inserting different yarns into the nonwoven fabric would satisfy a need in certain markets.

BRIEF SUMMARY

The subject invention provides non-woven fabrics having yarns of varying characteristics. In a preferred embodiment the subject invention provides nonwoven fabrics that comprise yarns of different deniers or cross sections. The use of these yarns gives the nonwoven fabric a unique appearance and advantageous properties. The subject invention further pertains to the processes used to produce these fabrics. In an embodiment specifically exemplified herein, the nonwoven fabric of the subject invention is made of a combination of a spunbonded nylon 6,6 fabric and nylon 6,6 yarns.

Specifically, the subject invention also provides a process for producing fabrics which have desired characteristics in terms of thickness, strength, hand or stiffness and appearance.

In a preferred embodiment, the appearance, stiffness, strength and thickness of a nonwoven nylon fabric is enhanced by inserting a 70 denier nylon 6,6 yarn with 34 filaments into the web through an attenuator jet onto a forming table and either thermally bonding or chemically bonding the fabric. In another embodiment, a different nonwoven fabric is produced by insertion of a 40 denier monofilament polyester yarn into the web through an attenuator jet onto a forming table and thermally bonding the fabric.

The fabrics of the subject invention have a unique appearance that is attractive and can be used for fashion applications. The inserted filaments form eddies and create a swirling pattern of yarn in the fabric. Polymers that are different from the base fabric can also be used to produce fabrics with contrasting patterns when dyes are applied. These fabrics can be used to give a unique appearance to wallpaper, clothing, scarves or other fashion materials.

DETAILED DISCLOSURE

This invention relates to nonwoven fabrics of novel appearance and enhanced properties made by inserting yarns into the top, middle or bottom of the fabric and bonding the resulting web. The yarns can have different deniers or cross sections than the filaments in the web. Yams can be composed of filaments of different polymers. Multiple kinds of yarns with different dye properties can also be used. Methods for making such a nonwoven material are also disclosed herein.

In the following detailed description of the subject invention and its preferred embodiments, specific terms are used in describing the invention; however, these are used in a descriptive sense only and not for the purpose of limitation. It will be apparent to the skilled artisan having the benefit of the instant disclosure that the invention is susceptible to numerous variations and modifications within its spirit and scope.

The present invention provides nonwoven fabrics that exhibit a unique appearance and enhanced properties. The subject invention further concerns the processes used to produce these nonwoven fabrics. The advantageous characteristics of the fabrics of the subject invention are achieved through the insertion of yarns into a fabric by depositing them and the filaments of the fabric onto a forming table. The yarns can be inserted into, on top of or below the fabric on the forming table. Yarns of different polymers, deniers or cross sections can be used. Yarns of different dyeing properties than the fabric can also be used.

One aspect of the subject invention is a nonwoven fabric with a basis weight between about 7 grams per square meter and about 250 grams per square meter containing inserted yarn or yarns that are at least about 1.5 times as long as the linear length of said fabric. In a specific embodiment, the fabric has a threadline denier of the inserted yarn or yarns at least twice the denier per filament of the fabric. In a preferred embodiment, the denier per filament of the insert yarn or yarns is at least 1. Preferably, at least one filament is inserted per eighteen centimeters of fabric width.

The fabric may be made from, for example, polyester, polyamide, polyimide, polypropelene, polyethylene, polystyrene, teflon, fiberglass, polytrimethylene, polylactic acid, polycarbonate, polyester terephthalate or polybutylene terephthalate, or blends or copolymers thereof. The fabric may, optionally be pigmented or dyed. In specific embodiments, the fabric may be monofilament, multifilament or cabled yarn or a combination thereof. The fabric may contain conjugate or bicomponent filaments or multicomponent filaments. The inserted yarn or yarns may, optionally, have different dye properties than the filaments of the fabric.

The cross section of the inserted filaments may be, for example, round, trilobal, multilobal crescent, cross or X, E or oval shaped. The cross section of the inserted filaments may also contain voids or can be hollow filaments.

The fabric may be made by the spunbond process, the needle punch process, the carding process, the wet laid or dry laid process, or by the hydroentangling process.

The yarns can be inserted into, on or under the fabric using a method such as selected attenuation jets, slot attenuation devices, mechanical feed devices and free falling.

The fabrics produced during the process of the subject invention may be bonded chemically, ultrasonically, or thermally. In one embodiment, HC1 gas and water vapor can be applied to achieve bonding. In another embodiment, the filaments may be heated to, for example, between 180° C. and about 250° C. Preferably, the filaments are heated to between about 200° C. and 235° C.

In specific embodiments, the subject invention pertains to:

1. A nonwoven fabric with a basis weight between about 7 grams per square meter and about 250 grams per square meter containing inserted yarn or yarns that are at least 1.5 times as long as the linear length of the fabric.

2. A nonwoven fabric with a basis weight between about 7 grams per square meter and 250 grams per square meter containing inserted yarn or yarns that are at least 1.5 times as long as the linear length of the fabric where the threadline denier of the inserted yarn or yarns are at least twice the denier per filament of the fabric.

3. A nonwoven fabric with a basis weight between about 7 grams per square meter and 250 grams per square meter containing inserted yarn or yarns that are at least 1.5 times as long as the linear length of the fabric where at least one filament is inserted per eighteen centimeters of fabric width.

4. A nonwoven fabric with a basis weight between about 7 grams per square meter and 250 grams per square meter containing inserted yarn or yarns that are at least 1.5 times as long as the linear length of the fabric where the denier per filament of the inserted yarn or yarns are at least 1.

5. A nonwoven fabric with a basis weight between about 7 grams per square meter and 250 grams per square meter containing inserted yarn or yarns that are at least 1.5 times as long as the linear length of the fabric where the yarn or yarns inserted into the fabric are made of polyesters, polyamides, polyimides, polypropelene, polyethylene, polystyrene, Teflon, fiberglass, polytrimethylene, polylactic acid, polycarbonates, terephthalate or polybutylene terephthalate and blends or copolymers thereof.

6. A nonwoven fabric with a basis weight between about 7 grams per square meter and 250 grams per square meter containing inserted yarn or yarns that are at least 1.5 times as long as the linear length of the fabric where the inserted yarn or yarns are pigmented or dyed.

7. A nonwoven fabric with a basis weight between about 7 grams per square meter and 250 grams per square meter containing inserted yarn or yarns that are at least 1.5 times as long as the linear length of the fabric where the yarn or yarns inserted into the fabric are a monofilament, multifilament or cabled yarn or a combination thereof.

8. A nonwoven fabric with a basis weight between about 7 grams per square meter and 250 grams per square meter containing inserted yarn or yarns that are at least 1.5 times as long as the linear length of the fabric where the yarn or yarns inserted into the fabric contain conjugate or bicomponent filaments.

9. A nonwoven fabric with a basis weight between about 7 grams per square meter and 250 grams per square meter containing inserted yarn or yarns that are at least 1.5 times as long as the linear length of the fabric where the inserted yarn or yarns have different dye properties than the filaments of the fabric that said yarn or yarns are inserted into.

10. A nonwoven fabric with a basis weight between about 7 grams per square meter and 250 grams per square meter containing inserted yarn or yarns that are at least 1.5 times as long as the linear length of the fabric where the cross section of the inserted filaments are round, trilobal, multilobal crescent, cross or X, E or oval shaped.

11. A nonwoven fabric with a basis weight between about 7 grams per square meter and 250 grams per square meter containing inserted yarn or yarns that are at least 1.5 times as long as the linear length of the fabric where the cross section of the inserted filaments contain voids or are hollow filaments.

12. A nonwoven fabric with a basis weight between about 7 grams per square meter and 250 grams per square meter containing inserted yarn or yarns that are at least 1.5 times as long as the linear length of the fabric wherein said nonwoven fabric is made by the spunbond process.

13. A nonwoven fabric with a basis weight between about 7 grams per square meter and 250 grams per square meter containing inserted yarn or yarns that are at least 1.5 times as long as the linear length of the fabric wherein said nonwoven fabric is made by the needle punch process.

14. A nonwoven fabric with a basis weight between about 7 grams per square meter and 250 grams per square meter containing inserted yarn or yarns that are at least 1.5 times as long as the linear length of the fabric wherein said nonwoven fabric is made by the carding process.

15. A nonwoven fabric with a basis weight between about 7 grams per square meter and 250 grams per square meter containing inserted yarn or yarns that are at least 1.5 times as long as the linear length of the fabric wherein said nonwoven fabric is made by the wet laid or dry laid process.

16. A nonwoven fabric with a basis weight between about 7 grams per square meter and 250 grams per square meter containing inserted yarn or yarns that are at least 1.5 times as long as the linear length of the fabric wherein said nonwoven fabric is made by the hydroentangling process.

It should be understood that the examples and embodiments described herein are for illustrative purposes only and that various modifications or changes in light thereof will be suggested to persons skilled in the art and are to be included within the spirit and purview of this application.

EXAMPLE 1

Samples of nonwoven fabrics with unique appearance were produced by inserting a 70 denier threadline with 34 round filaments into a nylon 6,6 spunbonded fabric. Nylon 6,6 70-34-R25, Merge 18234, supplied by DuPont was used. The yarns were inserted into one or more jets of an array of attenuating jets used to deposit round, nylon 6,6 filaments onto a forming table to produce the samples described below. A slot draw system can be used instead of attenuation jets. The yarns can also be allowed to fall freely onto a forming table or a brake can be added to any of the feed systems discussed previously. A feed roll or a set of feed rolls can also be used especially if it is desirable to accurately meter the length of yarn to insert into the fabric.

In one example, one threadline of the 70 denier yarn was inserted into a 10 grams per square meter (gsm) fabric at a rate of 17.5 meters per linear meter of fabric. In another example, four threadlines of 70 denier yarn were inserted per thirty-five centimeters of fabric width into a 10 gsm fabric at approximately 17.5 meters per linear meter of fabric. In a third example, four threadlines of 70 denier yarn were inserted per seventy centimeters of fabric width into a 10 gsm fabric at approximately 17.5 meters per linear meter of fabric.

The yarn can be inserted on the top of the fabric, the bottom or in between the two layers of filaments that make up the spunbonded fabric.

The yarn was inserted on the bottom of the fabric in these examples. The resulting webs were then transported to a chemical bonding station or "gas house" which exposes the filaments to an activating agent (i.e., HC1) and water vapor. Upon leaving the bonding station, the webs were passed between rolls which compress and bond the web. The webs were then dried with a through air dryer and the resulting fabrics were wound up. These same webs can also be thermally bonded by directing them to a calender where about 20% of the surface area can be bonded at discrete points at a temperature of about 431° F.

The resulting fabrics described in these examples had an artistic appearance that is attractive and can be used for fashion applications. The inserted filaments formed eddies and created a swirling pattern of yarn in the fabric. These fabrics can be used to give a unique appearance to wallpaper, clothing, scarves or other fashion materials.

Thickness and grab strength were measured on one sample and a control are presented in Table 1 below. Table 1 also compares the properties of the samples to properties of the base fabric without the inserted yarns. The thickness, strength and stiffness are higher when the yarn is inserted.

TABLE 1

Properties of fabrics containing 70 denier yarns

| Yarns per meter width of fabric | Fabric filament shape | Yarn filament shape | Thickness | Machine Direction Grab Strength | Stiffness |
|---|---|---|---|---|---|
| 0 | Round | Round | 2.57 | 10.49 | −0.067 |
| 11.4 | Round | Round | 3.48 | 11.12 | −0.158 |

EXAMPLE 2

Samples of nonwoven fabrics with unique appearance were produced by inserting a 70 denier threadline with 34 round filaments into a nylon 6,6 spunbonded fabric made of filaments with a trilobal cross section. Nylon 6,6 70-34-R25, Merge 18234, supplied by DuPont was used. The yarns were inserted into one jet of an array of attenuating jets used to deposit nylon 6,6 filaments onto a forming table to produce the samples described below. A slot draw system can be used instead of attenuation jets. The yarns can also be allowed to fall freely onto a forming table or a brake can be added to any of the feed systems discussed previously. A feed roll or a set of feed rolls can also be used especially if it is desirable to accurately meter the length of yarn to insert into the fabric.

In one example, one threadline of the 70 denier yarn was inserted into a 15 (gsm) fabric made with trilobal filaments at a rate of 17.5 meters per linear meter of fabric. The yarns were inserted on the top of the fabric, in between the two layers of the fabric and on the bottom of the fabric. The resulting webs were then transported to a chemical bonding station or "gas home" which exposes the filaments to an activating agent (i.e., HC1) and water vapor. Upon leaving the bonding station, the webs were passed between rolls which compress and bond the web. The webs were then dried with a through air dryer and the resulting fabrics were wound up. These same webs can also be thermally bonded by directing them to a calendar where about 20% of the surface area can be bonded at discrete points at a temperature of about 431° F.

As in example 1, the resulting fabrics described in these examples had an artistic appearance that is attractive and can be used for fashion applications. The inserted filaments formed eddies and created a swirling pattern of yarn in the fabric.

Thickness, stiffness and grab strength were measured and are presented in Table 2 below. Table 2 also compares the properties of the samples to properties of the base fabric without the inserted yarns. The thickness is higher on all samples.

TABLE 2

Properties of fabrics containing 70 denier yarns

| Yarns per meter width of fabric | Insertion position | Fabric filament shape | Yarn filament shape | Thick-ness | Strength | Stiff-ness |
|---|---|---|---|---|---|---|
| 1 | Top | Trilobal | Round | 6.3 | 15.6 | 0.127 |
| 1 | Middle | Trilobal | Round | 5.3 | 14.5 | 0.114 |
| 1 | Bottom | Trilobal | Round | 4.7 | 15.1 | 0.098 |
| 0 | None | Trilobal | Round | 2.9 | 15.6 | 0.099 |

EXAMPLE 3

Another sample of nonwoven fabric with a unique appearance was produced by adding polyester monofilaments in a spunbonded nylon nonwoven process. The nylon 6,6 polymer was melted and extruded at a temperature of about 300° C. Round filaments were attenuated and drawn pneumatically using aspirating jets and deposited onto a lay down or forming box. A slot draw system can also be used. Forty denier, monofilament, polyester yarn under the tradename "Filster" supplied by FIL. VA s.r.l. was inserted in one attenuator position set at an operating pressure of approximately 70 psig. The resulting web was then directed to a calender where about 20% of the surface area was bonded at discrete points at a temperature of about 431° F.

EXAMPLE 4

Samples of nonwoven fabrics with unique appearance were produced by inserting a size 46, white polypropelene thread with multiple filaments. Lot 02067-050-001 supplied by Synthetic Thread Company was used. The yarn was inserted into one jet of an array of attenuating jets used to deposit nylon 6,6 filaments onto a forming table to produce the samples described below. Different insertion systems as described in previous samples can also be used.

In one example, one threadline of the size 46 thread was inserted into a 15 (gsm) fabric made with trilobal filaments at a rate of 9.8 meters per linear meter of fabric. The yarns were inserted on the bottom of the fabric and in between the two layers of the fabric. The resulting webs were then transported to chemical bonding station or "gas house" which exposes the filaments to an activating agent (i.e., HC1) and water vapor. Upon leaving the bonding station, the webs were passed between rolls which compress and bond the web. The webs were then dried with a through air dryer and the resulting fabrics were wound up. These same webs can also be thermally bonded by directing them to a calender where about 20% of the surface area can be bonded at discrete points at a temperature of about 431° F.

The resulting fabrics were dyed in a wine 10 Rit® liquid dye and in a Royal Blue 29 Rit® liquid dye for about two minutes. The dyed fabrics in these examples had an artistic appearance that is attractive and can be used for fashion applications. The inserted filaments formed eddies and created a swirling pattern of yarn in the fabric. These swirls did not dye in the Rit® liquid dyes and gave an attractive contrasting pattern to the fabric. As in previous examples, these fabrics described in these examples can be used for fashion applications.

It should be understood that the examples and embodiments described herein are for illustrative purposes only and that various modifications or changes in light thereof will be suggested to persons skilled in the art and are to be included within the spirit and purview of this application.

We claim:

1. A spunbonded nonwoven fabric with a basis weight between about 7 grams per square meter and 250 grams per square meter comprising a plurality of continuous filaments and an inserted yarn, wherein the said inserted yarn is made from the group consisting of polyester, polyamide, polyimde, polypropylene, polyethylene, polystyrene, TEFLON, fiberglass, polytrimethylene, polylactic acid, polycarbonate, polyester terephthalate, or polybutylene terephthalate, or blends or copolymers thereof, wherein the said inserted yarn is at least 1.5 times as long as the linear length of said fabric, wherein the said continuous filaments and the inserted yarn are subjected to a bonding system.

2. The fabric of claim 1 wherein the threadline denier of the inserted yarn is at least twice the denier per filament of the fabric.

3. The fabric of claim 1 wherein at least one yarn is inserted per eighteen centimeters of fabric width.

4. The fabric of claim 1 wherein the denier per filament of the inserted yarn is at least 1.

5. The fabric of claim 1 wherein the inserted yarn is pigmented or dyed.

6. The fabric of claim 1 wherein the yarn inserted into the fabric is a monofilament, multifilament or cabled yarn or a combination thereof.

7. The fabric of claim 1 wherein the yarn inserted into the fabric comprises conjugate or bicomponent filaments or multicomponent filaments.

8. The fabric of claim 1 wherein the inserted yarn has different dye properties than the filaments of the fabric that said yarn is inserted into.

9. The fabric of claim 1 wherein the cross section of filaments of the inserted yarn are round, trilobal, multilobal crescent, cross or X, E or oval shaped.

10. The fabric of claim 1 wherein the cross section of filaments of the inserted yarn contain voids or are hollow filaments.

11. The fabric of claim 1 wherein the inserted yarn is continuous.

* * * * *

UNITED STATES PATENT AND TRADEMARK OFFICE

CERTIFICATE OF CORRECTION

PATENT NO. : 7,175,902 B2
APPLICATION NO. : 10/273543
DATED : February 13, 2007
INVENTOR(S) : Albert E. Ortega et al.

It is certified that error appears in the above-identified patent and that said Letters Patent is hereby corrected as shown below:

Column 1,
Line 67, “setting the sickness” should read --setting the thickness--.

Column 2,
Line 15, “sunpbounded fabrics” should read --spunbonded fabrics--.
Line 61, “Yams can be” should read --Yarns can be--.

Column 3,
Line 29, “polypropelene” should read --polypropylene--.
Line 30, “teflon” should read --polytetrafluoroethylene--.

Column 4,
Line 16, “polypropelene” should read --polypropylene--.
Line 17, “Teflon” should read --polytetrafluoroethylene--.

Column 8,
Lines 13-14, “polyamide, polyimde” should read --polyamide, polyimide--.
Line 14, “TEFLON” should read --polytetrafluoroethylene--.
Lines 40-41, “multilobal crescent” should read --multilobal, crescent--.

Signed and Sealed this

Twenty-seventh Day of May, 2008

JON W. DUDAS
*Director of the United States Patent and Trademark Office*